United States Patent [19]

Bullock, III

[11] 4,437,593

[45] Mar. 20, 1984

[54] OVERCAP FOR SPICE CANISTER

[75] Inventor: Joseph J. Bullock, III, Atherton, Calif.

[73] Assignee: Three Sisters Ranch Enterprises, San Carlos, Calif.

[21] Appl. No.: 397,609

[22] Filed: Jul. 12, 1982

[51] Int. Cl.[3] ..... B65D 83/06

[52] U.S. Cl. ..... 222/541; 215/31; 215/256; 222/565

[58] Field of Search ..... 215/256, 31; 222/565, 222/547, 541

[56] References Cited

U.S. PATENT DOCUMENTS

| | | | |
|---|---|---|---|
| 2,576,416 | 11/1951 | Randlett | 222/565 X |
| 3,885,695 | 5/1975 | Schaefer | 215/216 X |
| 4,166,552 | 9/1979 | Faulstich | 215/31 X |

FOREIGN PATENT DOCUMENTS

| | | | |
|---|---|---|---|
| 710851 | 6/1954 | United Kingdom | 222/547 |
| 1385034 | 2/1975 | United Kingdom | 215/224 |

*Primary Examiner*—Donald F. Norton

*Attorney, Agent, or Firm*—Julian Caplan

[57] ABSTRACT

A container neck has a bead mating with the internal bead on the lower end of the skirt of a sifter fitment. A plastic tamper-proof cap fits over the fitment and has a skirt having two vertically spaced internal beads locking under the shoulders of external beads on the container neck. The cap skirt has a first score line immediately above the lower internal cap bead and a second score line extending from the first score line to the bottom edge of the cap skirt. Preferably both the internal cap beads are interrupted. The cap has a peripheral flange, the underside of which slants downward-inward.

4 Claims, 4 Drawing Figures

OVERCAP FOR SPICE CANISTER

This invention relates to a new and improved overcap for a spice canister, or similar container. Conventionally, containers for spices have been formed with a "fitment" which detachably or permanently fits over the upper end of the container and is formed with holes so that the contents may be discharged by shaking the container. Heretofore, overcaps for such container have generally been screw caps.

The present invention provides a tamper-proof cap which fits over the fitment and the container neck and is applied by pushing down on the cap so that it snaps over beads on the container neck and is held in place until the skirt of the cap is torn by the consumer. Thus, tearing the skirt discloses that there has been tampering with the contents of the container.

In intact condition, the cap seals the container from contact with the air and thus reduces deterioration of the contents during storage. Further, experience has shown that patrons of markets sometimes open spice containers to sample the contents for aroma or taste, or even pilfer the contents. The present invention prevents opening the container without detection. After the consumer has opened the container by tearing off the bottom of the skirt, the upper portion of the cap constitutes a reclosure cap which may be repeatedly removed for discharge of contents and replaced to restrict entry of air and contaminants into the interior of the container between uses.

Reference is made to U.S. Pat. No. 4,166,552, which discloses the advantages of interrupted beads on the interior wall of the skirt of the cap, located above and below the horizontal tear line of the cap. Interruption of the beads makes it possible for the skirt to stretch when the cap is being installed on the bottle neck in a conventional capping machine. Hence, the force required to seat the cap on the neck is lessened and this materially reduces the tendency of the neck of the bottle to be crushed or deformed during capping.

Another important advantage of the use of interrupted beads on the cap is that it enables the container to be formed of blow-molded thinwall plastic material, since the tendency to crush the container when the bottle cap is applied is reduced. Heretofore, spice containers have generally been made of glass or thick-walled plastic. The present invention permits the use of lighter weight and less expensive construction.

One of the distinctions over the cap described in U.S. Pat. No. 4,166,552 is the elimination of the inner skirt which fits inside the bottle neck. Another distinction over the aforesaid patent is the provision of extra length of the cap skirt above the upper beads to accommodate the height of the overcap. The present invention, in addition to these advantages has the important advantage that it permits the use of spice containers with overcaps to be made lightweight and of less expensive materials.

An additional feature of the present invention is the fact that the container neck has a top external bead which snaps over an external bead on the inside of the skirt of the fitment. The fact that the container neck is of a thinwalled, flexible, blow-molded plastic makes such interfitting possible.

After the bottom of the cap skirt has been torn off, the remaining portion is a reclosure cap which is removed and reapplied repeatedly until the contents of the container are exhausted. The cap is provided with a peripheral flange which may be gripped to remove the reclosure cap. The underside of the flange is beveled to prevent a dishonest person from prying off the cap before the bottom of the skirt has been torn off.

Other objects of the present invention will become apparent upon reading the following specification and referring to the accompanying drawings in which similar characters of reference represent corresponding parts in each of the several views.

Figure 1:
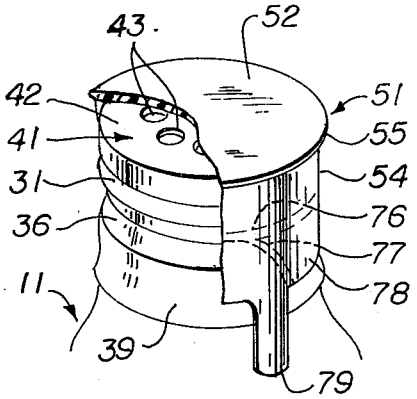
FIG. 1 is a perspective view partly broken away to reveal internal construction showing a cap in intact condition seated on a container neck which also is provided with a fitment.

Container neck 11 has a horizontal top edge 12. This surface fits against the underside of the fitment 41, as hereinafter described. Considering first the interior of the neck 11, below the surface 12 is a top internal vertical wall 13 of a length approximately equal to the length of the skirt 44 of fitment 41. Below wall 13 is a downward-outward slanted wall 14 which terminates in top internal circumferential groove 16. Below groove 16 is a substantially horizontal outwardly directed ledge 17 which terminates in second internal vertical wall 18, having approximately the same internal diameter as wall 13. At the lower end of wall 18 is second downward-outward slanted wall 19 which terminates in second internal groove 21. Below groove 21 is a downward-inward slanted wa11 22 which terminates in third internal vertical wall 23 which is of the same radius as walls 13 and 18. The shape of the interior of neck 11 below wall 23 is a matter of choice.

Considering now the exterior of neck 11, top edge 12 has a rounded outer corner 26 which merges with top external downward slanted wall 27 terminating in top external groove 28 to define top container bead 30. Top outward-downward extending ledge 29 extends outward from groove 28 and merges into top vertical external wall 31 which is outward of groove 16. Below wall 31 is top external inward directed horizontal ledge 32 which terminates in second external groove 23 to define second container bead 35. Below groove 33 is second external downward-outward slanted wall 34 which merges with and terminates in third external bead 36 which, as shown in the drawings is rounded. Below bead 36 is second external inward directed horizontal wall 37 which terminates in second external vertical wall 38. Below wall 38 is third downward-outward slanted wall 39. The wall 38 is opposite the internal wall 23.

Figure 3:
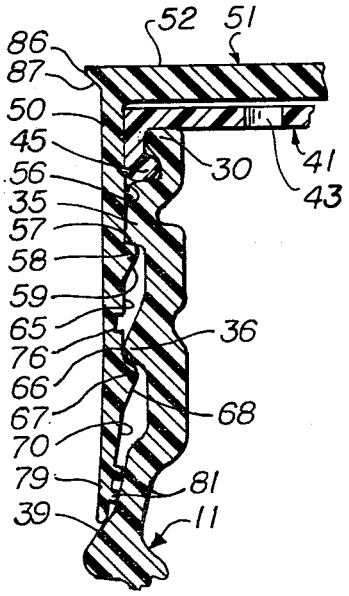
FIG. 3 is a sectional view showing the three parts assembled.

Fitment 41, in accordance with the present invention, has a top disc 42 formed with a plurality of shaker holes 43 and is surrounded by a vertical skirt 44. The interior of the skirt 44 has an internal groove 46 immediately below disc 42 which merges with downward-inward slanted wall 47 which terminates in curved inner corner 48 to define fitment bead 45. The skirt 44 has a bottom edge 49. As best shown in FIG. 3, the fitment bead 45 snaps over the container top bead 30 of neck 11. The resilient thin walled neck 11 facilitates the fitment 41 snapping into place. Bottom edge 49 rests on ledge 29. Once the fitment is in place, it cannot conveniently be removed, although removal is possible if the consumer so requires. It will also be seen that the fitment 41 can be attached to the neck 11 by conventional capping equipment.

Directing attention now to cap 51, the cap has a top disc 52 has a smooth bottom surface 53, which rests upon the top of top disc 42 of fitment 41. Below disc 52 is the skirt 50. Preferably there is a short outward projecting flange 55 at the level at the top of the disc 52 which assists the user in prying off the reclosure cap (which remains after the lower part of the skirt of cap 51 has been torn off). Flange 55 extends peripherally outward level with the top of disc 52 and terminates in a short vertical edge 86. Below edge 86 bead 55 has a beveled surface 87 extenting at about 45° to the outside of skirt 54. The bevel 87 prevents a dishonest person from digging his fingernails under the flange to pry off the entire cap 51 before the bottom of the skirt has been torn off.

Figure 2:
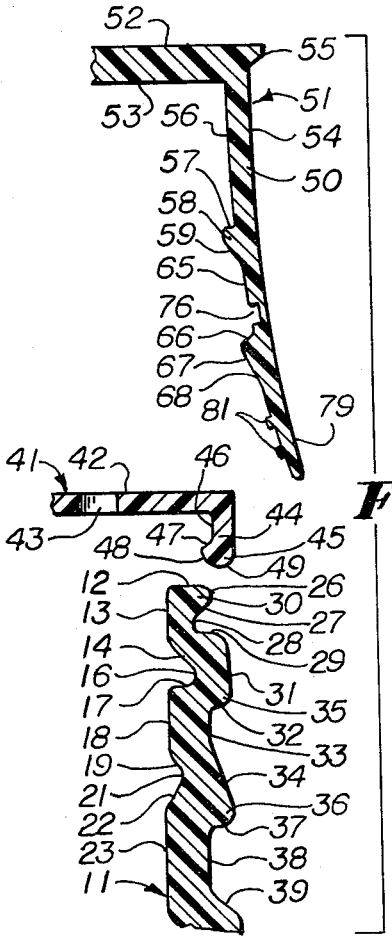
FIG. 2 is an exploded, enlarged, fragmentary sectional view through the cap fitment and bottleneck.

The external wall 54 of skirt 50 is preferably smooth and vertical, but, because of the flexible nature of the construction of the cap skirt (such as polyethylene) it may expand as shown in FIG. 2 to snap over the fitment 41 and neck 11.

Figure 4:
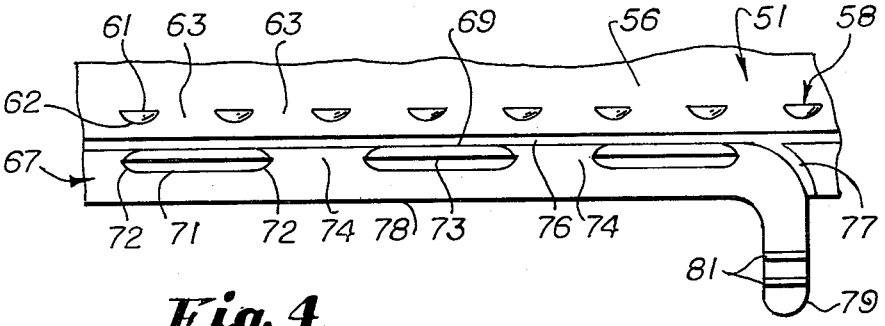
FIG. 4 is a schematic view of the interior of a portion of the outer cap skirt developed in a plane to show the interruptions of the upper and lower locking beads.

Considering now the interior of skirt 50, there is an elongated top internal vertical wall 56 of a length equal to the sum of the lengths of skirt 44 of the fitment and wall 31. Wall 56 terminates in top downward-inward slanted wall 57 of top cap bead sections 58. Below wall 57 is top downward-outward slanted wall 59, there being a rounded corner where wall 59 intersects wall 57. Bead sections 58 are spaced one from the other, as best shown in FIG. 4. Each of the bead sections 58 has an approximately horizontal top edge 61 and a downward-convex bottom edge 62. Gaps 63 occur between the beads 58.

Below bead sections 58 is second internal vertical wall 65 which terminates in second internal downward-inward slanted wall 56 which comprises the upper surfaces of lower bead sections 67. The lower surface of bead sections 67 comprise second downward-outward slanted wall 68. Directing attention again to FIG. 4, it will be seen that the top edges 69 of bead sections 67 are approximately horizontal, as are the bottom edges 71. At the extremities of the bead sections 67, there are rounded ends 72. The bead sections 67 slant inward from the surfaces 69 and 71 to a rounded apex 73. There are gaps 74 between bead sections 67. Below bead sections 67 the internal wall of skirt 50 extends approximately vertically downward, slanting somewhat outwardly.

It will be seen that the bead sections 58 are preferably small and are spaced apart in gaps 63 approximately one and one-half times the length of each section 58. The gap 74 between the lower bead sections 67 are, on the contrary, approximately one-half the lengths of the bead section 67. The lengths of bead section 67 are approximately four times the lengths of section 58.

Top internal horizontal groove 76 is formed immediately above the bead section 67 and spaced slightly below the sections 58. Curved internal groove 77 extends from groove 76 through one of the gaps 74 down to the bottom edge 78 of skirt 50. Below edge 78, immediately to one side of the groove 77, is a pull tab or tear tab 79. The interior of tab 79 may be formed with transverse ridges 81 to facilitate gripping the tab.

In the assembly of the combination, the product is first filled into the container by means forming no part of the present invention. Fitment 41 is then applied by pressing downward. The bead 45 slips over the bead 30 by reason of the upper end of the neck 11 flexing inward and the skirt 44 of the fitment flexing outward. Thereafter, the fitment 41 is substantially permanently locked to the container neck 11.

Cap 51 is then applied by pressing downwardly. Lower bead sections 67 first clear the disc 42 and skirt 44 of fitment 41 by reason of the skirt 50 flexing outwardly. Bead sections 67 also clear the container bead 35 and then the bead 36. This is accomplished by the skirt 50 stretching, and stretching is facilitated by reason of the fact that the beads 58 and 67 are interrupted by the gaps 63 and 74.

Meanwhile, the bead sections 58 clear the fitment 41 and the neck beads 31 and 36. It will thus be seen that the bead sections 58 lock under the neck bead 35 and the bead sections 67 lock under the neck bead 36. In this condition, the contents of the cap are sealed against air contact, and hence the spices or other product do not deteriorate during shelf storage, as would otherwise be the case. Furthermore, the cap cannot be removed by prying upward on the flange 50.

To open the container the consumer pulls upward on the tab 79, causing the skirt 50 to tear first along the curved score line 77 and then the circumferential horizontal score line 76, the lower part of the skirt 50, including the bead sections 67, being completely torn off. In this condition, it is possible for the user, merely by prying upward on the flange 55 to remove the remaining reclosure portion of the cap. In other words, the bead sections 58 expand outward to clear neck bead 35. This removal of the reclosure cap is facilitated because the bead sections 58 are relatively narrow and the gaps 63 therebetween are relatively wide. After the reclosure cap has been removed, the user may dispense condiments, etc., through the shaker holes 43 in conventional fashion. The reclosure cap may be reapplied and removed as frequently as required until the contents of the container are exhausted.

I claim:

1. In combination, a cap having a central top first disc, a thin-walled substantially cylindrical first skirt depending from adjacent the periphery of said first disc, said first skirt being scored and weakened in a circumferential first line spaced downwardly from the top of said first skirt and in a second line joining said first line and extending down to the bottom edge of said first skirt, a tab attached to said first skirt adjacent said second line, an upper internal circumferential bead on said first skirt between said first line and said disc, a lower internal circumferential second bead on said first skirt below, but adjacent, said first line, a fitment having a second disc formed with sifter holes and a short peripheral depending second skirt, the exterior of said second skirt being cylindrical and of an outer radius to seal tightly against the inside of said first skirt immediately below said first disc, the interior of said second skirt terminating in an internal third bead, and a container having a neck, the exterior of said neck having a fourth bead near its top shaped to fit inside the top of said second skirt and a first groove below said fourth bead shaped to receive said third bead, a fifth bead and a sixth bead vertically spaced from said fifth bead, each of said fifth and sixth beads having shoulders on their lower edges, said first and second beads fitting under the shoulders of said fifth and sixth beads, respectively, said first skirt sealing the contents of said container from deterioration by exposure to air both when said first skirt is intact and also after the portion of said first skirt below said first line has been torn away, the maximum radii of said fifth and sixth beads being about equal to the outer radius of said second skirt whereby said first and second beads may slide over said second skirt.

2. The combination of claim 1 in which at least one of said fifth and sixth beads is interrupted in a series of gaps spaced around the circumference of said outer skirt.

3. The combination of claim 1 in which said first disc is formed with a peripheral flange, the lower surface of said flange being at an inward-outward angle merging with the exterior of said first skirt, whereby if one attempts to pry said cap off said container with the fingernails, the nails slip upward on said lower surface of said flange.

4. A container for use with a cap having a central top first disc, a thin-walled first skirt depending from said first skirt, an upper internal circumferential bead on said first skirt, a lower internal circumferential second bead on said first skirt below said first bead and with a fitment having a second disc formed with sifter holes and a short peripheral depending second skirt having an outer radius about equal to the inner radius of said first skirt immediately below said first disc, said second skirt terminating in an internal third bead, said container having a neck, said neck having an exterior formed with a fourth bead near its top shaped to fit inside the top said second skirt and a first groove below said fourth bead shaped to receive said third bead, a fifth and a sixth bead vertically spaced below said fourth bead and having shoulders on their lower edges under which said first and second beads lock, said fifth and sixth beads having substantially equal radii each substantially greater than said fourth bead so that when said fitment is seated on said neck the exterior of said second skirt has substantially the same radius as the maximum radii of said fifth and sixth beads, whereby the inside of said first skirt may seal against the outside of said second skirt to protect the contents of said container against deterioration by exposure to air both when said first skirt is intact and also after the lower portion of said first skirt has been torn away and also said upper and lower beads may slide over said second skirt.

* * * * *